US007356978B2

(12) United States Patent
Dall'Omo et al.

(10) Patent No.: US 7,356,978 B2
(45) Date of Patent: Apr. 15, 2008

(54) METHOD FOR PRODUCING A PACK FOR GROUPS OF PRODUCTS AND MACHINE FOR IMPLEMENTING SAID METHOD

(75) Inventors: Davide Dall'Omo, Bologna (IT); Christian Zagnoni, Bologna (IT)

(73) Assignee: Tissue Machinery Company S.p.A., Bologna (IT)

( * ) Notice: Subject to any disclaimer, the term of this patent is extended or adjusted under 35 U.S.C. 154(b) by 0 days.

(21) Appl. No.: 11/641,329

(22) Filed: Dec. 19, 2006

(65) Prior Publication Data

US 2007/0137145 A1 Jun. 21, 2007

(30) Foreign Application Priority Data

Dec. 20, 2005 (IT) ..... BO2005A0774

(51) Int. Cl.
*B65B 9/22* (2006.01)

(52) U.S. Cl. ..... 53/450; 53/459

(58) Field of Classification Search ..... 53/450, 53/459, 469, 550, 567

See application file for complete search history.

(56) References Cited

U.S. PATENT DOCUMENTS 3,769,778 A 11/1973 Nordqvist
5,210,994 A * 5/1993 Lynn ..... 53/469
5,255,495 A 10/1993 Kovacs
5,339,609 A * 8/1994 Cerf ..... 53/550
5,524,420 A * 6/1996 Ikuta ..... 53/450
5,799,467 A 9/1998 Nankervis et al.
5,966,907 A * 10/1999 Julius ..... 53/450
7,165,378 B2 * 1/2007 Rimondi ..... 53/550

OTHER PUBLICATIONS

European Search Report for Application No. EP 06 12 6631 (Search Completed Mar. 2007).

* cited by examiner

*Primary Examiner*—John Sipos
(74) *Attorney, Agent, or Firm*—Fay Sharpe LLP

(57) ABSTRACT

A method for producing a pack (1) for groups (2) of rolls of products comprises the following steps: forming of a tube of film (3) around a frame (5) forming a channel (6) for the passage of the product groups (2); creation of a first seal (S1) on the front edges (7) of the film (3); insertion in the channel (6) of product groups (2), fed until they are close to the closed front end (7) of the film (3); further feeding of the product groups (2) with simultaneous feeding of the film (3) and formation of the further portion of the pack (1) beyond the frame (5); creation of a second, longitudinal seal (S2) on the overlapping longitudinal edges of the film (3) simultaneously with the further feed step; creation of a third seal (S3) on the rear edges (11) of the film (3) designed to close the pack (1) at the rear of the product groups (2) bagged; between the step of insertion of product groups (2) in the channel (6) and the further feeding of the product groups (2), there being a step of feeding the film (3) wound around the frame (5), simultaneously with and in the same direction as the feeding of the product groups (2), designed to allow a fixed distance (D) to be maintained between the closed front end (7) of the film (3) and the front end (2*a*) of the product groups (2) fed forward.

7 Claims, 7 Drawing Sheets

METHOD FOR PRODUCING A PACK FOR GROUPS OF PRODUCTS AND MACHINE FOR IMPLEMENTING SAID METHOD

BACKGROUND OF THE INVENTION

The present invention relates to a method for producing a pack for groups of products and to a machine for implementing said method, in particular, but without limiting the scope of the invention, for kitchen and/or toilet rolls.

In particular, this text focuses on bagging machines normally used for overwrapping a predetermined number of groups of products already packaged in plastic film, although this does not limit the scope of the invention, since the groups of products may also be pluralities or batches of loose products.

These groups of products are grouped together in predetermined batch configurations then fed, one after another, into a tubular packaging film wrapper.

These bagging machines, which usually form a final station of machines for producing the above-mentioned groups of products, bag the groups of products in tubular wrappers automatically formed by the bagging machine on the products to be overwrapped.

In practice, the machine forms the wrapper starting with a flat strip of packaging material film (fed from a reel positioned below a surface for movement of the groups of products). The strip of film is gradually folded over itself by special folder elements, forming a tube, supported from the inside of the wrapper being formed by suitable supporting elements (so that it forms a "tunnel" with a quadrangular cross-section), and having the longitudinal edges drawn near and overlapping one another.

There are also first sealing means positioned in front of the wrapper and the folder elements, angled transversally to the tubular shape, which then allow the wrapper to be sealed transversally to form, in sequence, a closed front end and a closed rear end.

Finally, second sealing means, angled longitudinally to the wrapper and opposite the longitudinal edges, close the tubular wrapper longitudinally to completely close the overwrap.

Basically, the process for forming the overwrap on the groups of products comprises the following steps:

- forming the overwrap with the film around the folders and the supporting elements;
- first seal at the front of the overwrap film;
- insertion in the channel formed by the folders of a predetermined number of product groups, until they make contact with the closed front end of the wrapper;
- further feeding of the product groups beyond the transversal sealers, simultaneously feeding the film from the reel thanks to the pushing motion of the products, and formation of the overwrap, gradually as the closed front end is fed along the machine together with the products inserted;
- simultaneously with the formation of the overwrap the overlapping edges of film are longitudinally sealed by the second sealing means;
- further activation of the first, transversal sealing means designed to close the overwrap wrapper at the rear of the products already bagged;
- cutting to separate the bag obtained in this way from the rest of the film, using cutting means, thus starting a new and subsequent bagging cycle for the product groups.

However, the machine structured in this way and the related operating cycle have disadvantages due to:

- rather lengthy times required for overwrapping which, at present, sets an operating limit for all of the stations upstream of the bagging machine, which, over time, have been improved in terms of product quality and operating times; and
- relatively low strength of the front seal at the current operating speeds.

In particular, on the current bagging machine the point on which such problems are focused is the sealing speed, in particular on the front transversal sealing speed.

The film sealing is a time T divided into two separate operating sub-times, that is to say, the film melting time T1 and the seal cooling time T2: where the time T1 for melting the material is relatively low, whilst the cooling time T2 is relatively long, since the quality and strength of the seal is increased only after cooling.

Consequently, with the current cycle and with a transversal sealer fixed in a position, the front sealing times have to be observed in order to prevent the overwrap from breaking above all when the product groups fed forward come into contact with the front seal. As already indicated, product feed results in subsequent development of the overwrap.

SUMMARY OF THE INVENTION

The aim of the present invention is therefore to overcome the above-mentioned disadvantages with a method and relative machine for producing a pack or overwrap for product groups which are highly productive in the unit of time and provide an end product with good strength and quality.

Accordingly, the present invention achieves this aim with a method for producing packs for groups of roll products, in particular a method and a machine for bagging groups of products with the technical features described in one or more of the claims herein.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

With reference to the accompanying drawings, and in particular with reference to FIGS. 1 to 8, the method and machine in accordance with the invention are used to obtain a pack or wrapper—bag 1 of groups 2 of roll products, in particular, but without limiting the scope of the invention, for kitchen and/or toilet rolls.

In this text reference is made to a process for bagging product groups 2 already packaged in film and grouped into batches, although this does not limit the solution which may also be used for groups of loose products to be bagged with a sheet of film.

Figure 8:
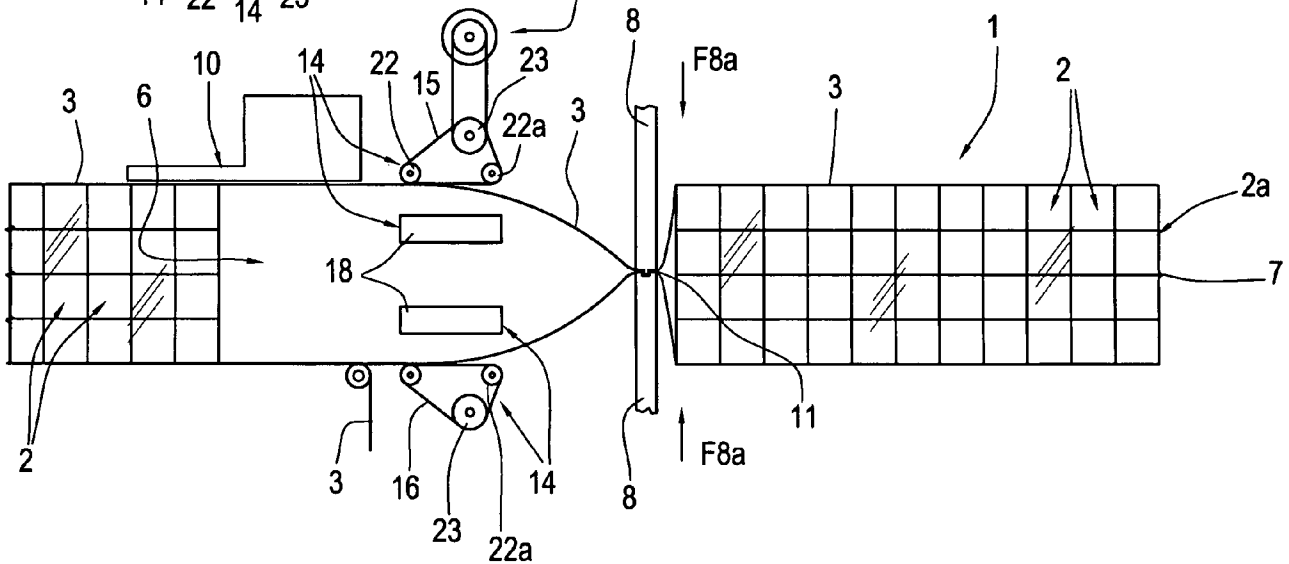

The method disclosed comprises the following steps (see FIGS. 1 to 8):

- forming of a continuous tube of film 3 around supporting and folder means 4 which constitute a frame 5 forming a channel 6 for the passage of the product groups 2 (see FIG. 2);
- creation of a first seal S1 on the front 7 edges of the packaging film 3, using first, transversal sealing means 8 positioned close to the front end of the frame 5 (see also FIG. 3 arrow F8);
- insertion in the channel 6, by pusher means 9, of a predetermined number of product groups 2, fed until they are close to the closed front end 7 of the film 3 (see FIG. 4 arrow F9);
- further feeding of the product groups 2 beyond the first sealing means 8, with simultaneous feeding of the film 3 and formation of the further portion of the pack 1 beyond the frame 5 (see FIG. 6);
- creation of a second, longitudinal seal S2 on the overlapping longitudinal edges of the film 3, by second sealing means 10, simultaneously with the further feed step;
- creation of a third seal S3 on the rear edges 11 of the film 3, by the first, transversal sealing means 8, designed to close the pack 1 at the rear of the product groups 2 bagged (see FIG. 8 arrow F8*a*).

Figure 4:
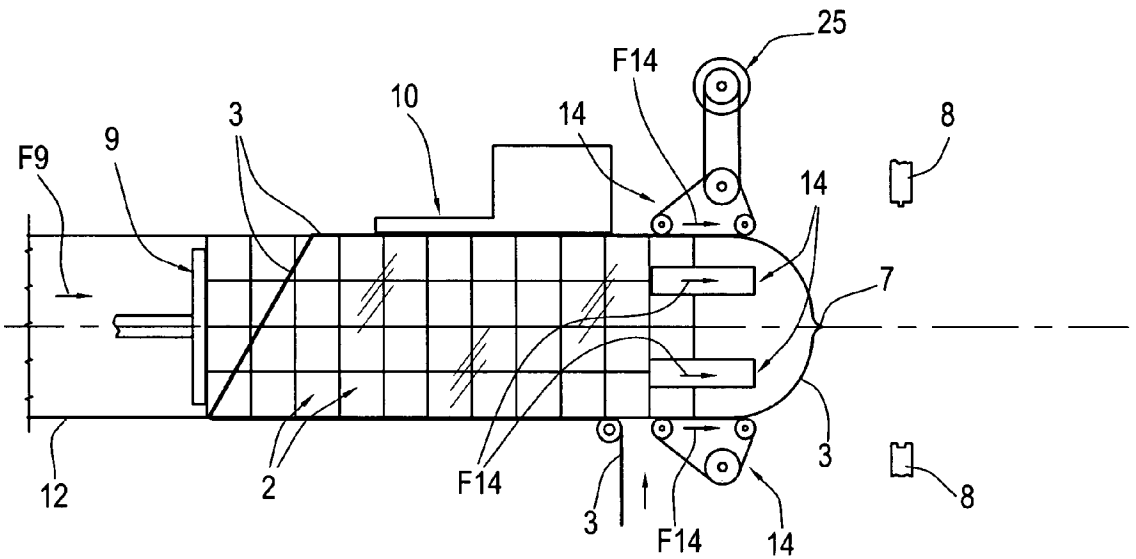
Figure 5:
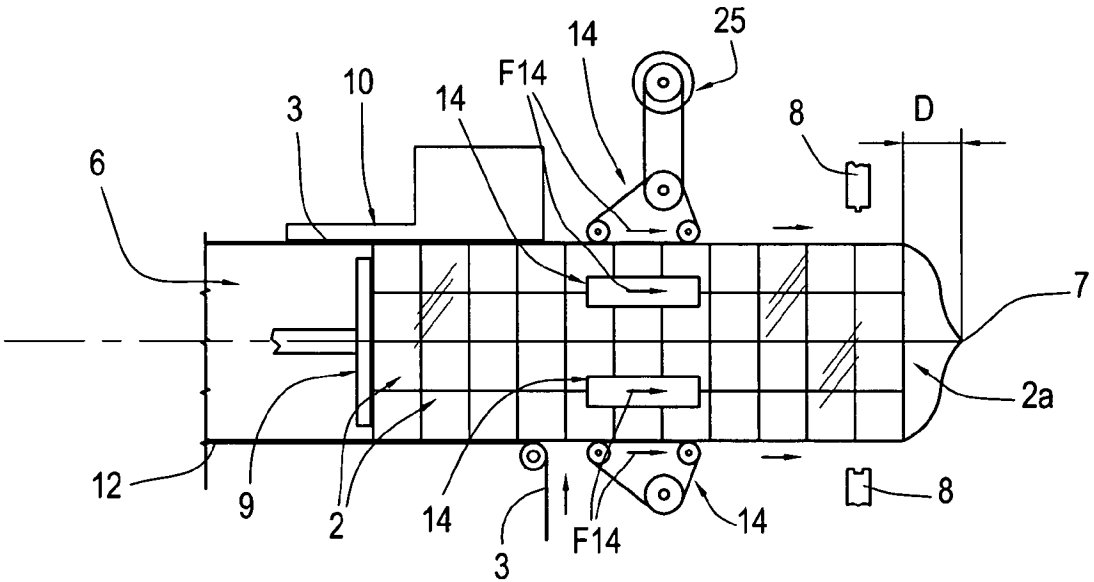
Figure 6:
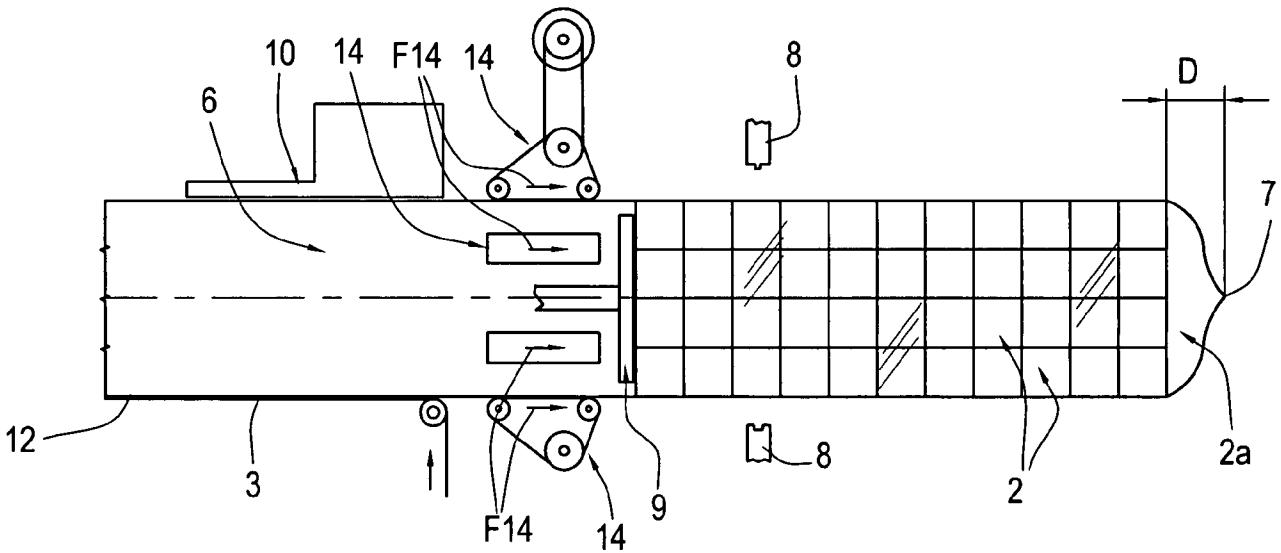

FIGS. 4 to 6 show how, between the step of inserting product groups 2 in the channel 6 (FIGS. 3 and 4) and the further feeding of said product groups 2 (FIGS. 5 and 6), there is a step of feeding the film 3 wound around the frame 5 (see arrows F14 in FIGS. 4 to 6), simultaneously in the same direction as the product groups 2, designed to allow a fixed distance D to be maintained between the closed front end 7 of the film 3 and the front end 2*a* of the product groups 2 fed forward: this is all done by feed means 14.

This film 3 feed step may be continued at least until the product groups 2 exit the channel 6, or in any event until the product groups 2 are positioned beyond the first, transversal sealing means 8.

Alternatively, the film 3 feed step may continue at least until the first seal S1 on the front edges 7 of the film 3 has cooled.

FIG. 4 shows how the film 3 feed step begins at and simultaneously with arrival of the product groups 2 close to the front end of the frame 5 and this feed step is performed evenly along the entire perimeter of the film 3 formed by the channel 6.

Figure 7:
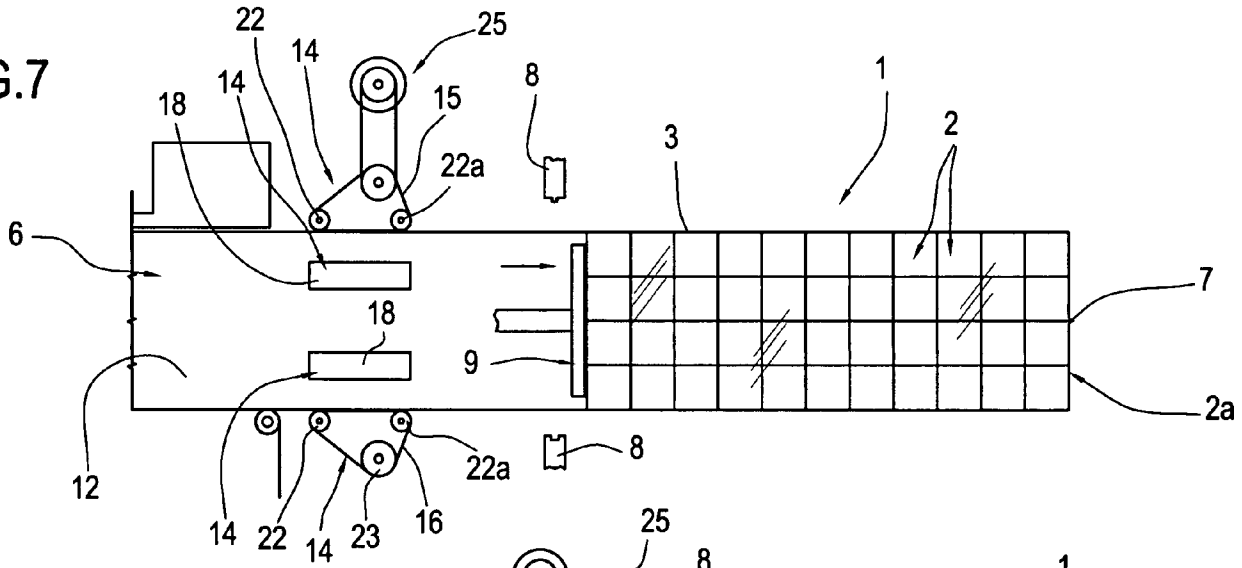

As illustrated in FIG. 7, before said step for creation of a third seal S3 on the rear edges 11 of the film 3, there may be a further step of feeding the product groups 2 until the product groups 2 make contact with the front end 7 of the film 3, by the pusher means 9, to reduce or completely eliminate the distance D.

Figure 1:
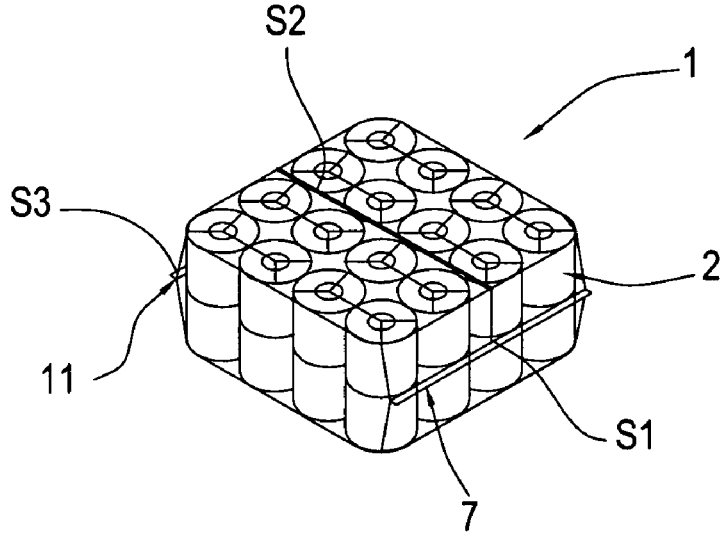
FIG. 1 is a perspective view of a wrapper obtained using the method and machine in accordance with the present invention.
Figure 2:
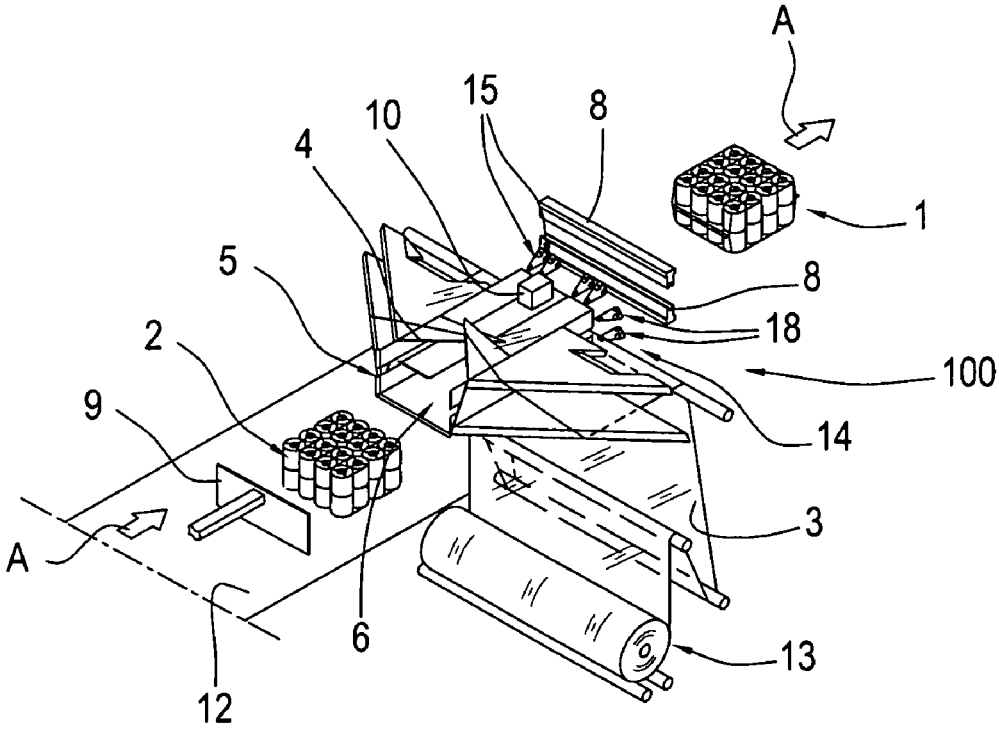
FIG. 2 is a perspective view with some parts cut away to better illustrate others, of the machine implementing the method for packaging groups of roll products in accordance with the present invention.
Figure 3:
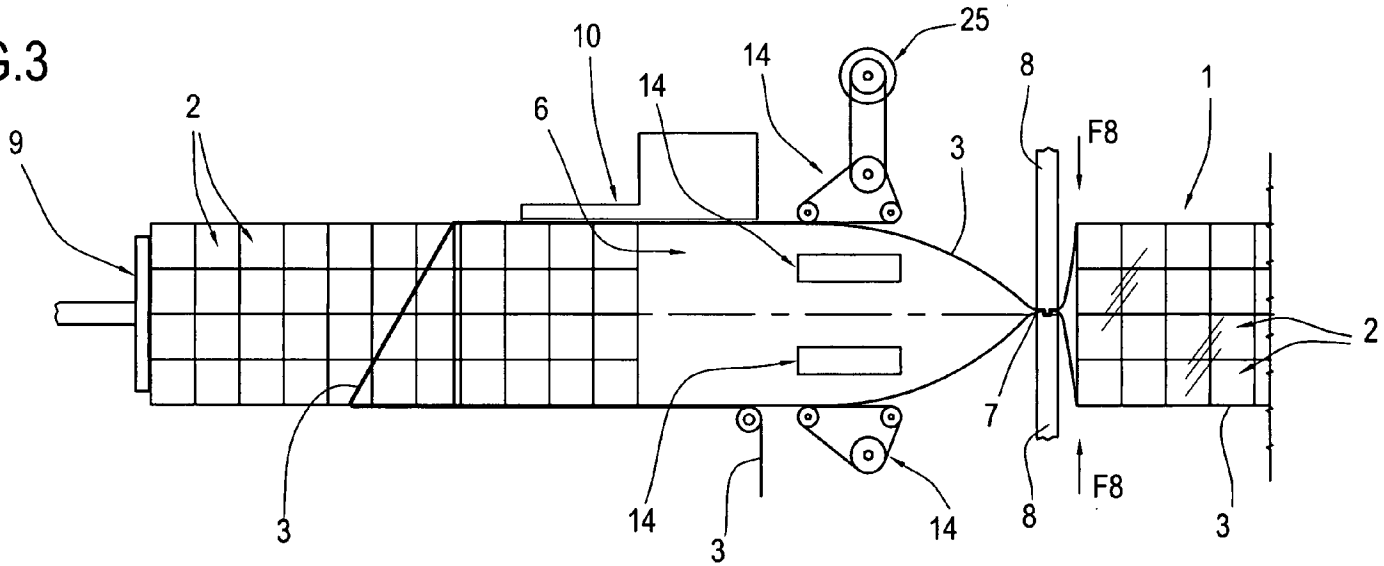
FIGS. 3 to 8 are schematic side views with some parts cut away to better illustrate others, of a succession of steps in the packaging method disclosed.

As illustrated in FIGS. 1 and from 9 to 11, the bagging machine 100 for producing the pack 1 for product groups 2 described above basically comprises:

- a surface 12 for supporting the product groups 2, extending horizontally, formed by an elevator (of the known type) designed to allow positioning of the product groups 2 on the operating line of the pusher means 9 before production of the pack 1;
- the frame 5 consisting of the folder means 4 designed to support the packaging film 3, which is wound around the folder means 4 and can be fed from a station 13 (for example a reel positioned below the frame 5); the frame 5, as said, forms the channel 6 for the passage of the product groups 2 fed, by the pusher means 9, in a direction of feed A and along the elevator 12;
- the first, transversal sealing means 8 (consisting of two sealing bars) positioned downstream of the frame 5, relative to the direction of feed A, and designed to join, respectively, the front edges 7 of the packaging film 3, before arrival of the product groups 2, and the rear edges 11 after the product groups 2 wrapped in the packaging film 3 have passed beyond the first sealing means 8;
- the second, longitudinal sealing means 10, positioned close to the frame 5 (for example above the frame 5), and designed to join two longitudinal edges of the film 3 when the pack 1 is formed.

The frame 5, the folder means 4, the first and second sealers 8 and 10 are schematically described, being well known to those in the trade.

In addition, the machine 100 comprises the above-mentioned film 3 feed means 14, positioned close to the frame 5, and designed to allow film 3 feed in the same direction as the direction of feed A, when the product groups 2 move close to the sealed front edges 7 of the film 3, and so as to maintain a fixed distance D between the sealed front edges 7 and the respective front end 2*a* of the product groups 2 fed forward.

In more detail, these feed means 14 are positioned between the frame 5 and the first sealing means 8, forming a stretch of the frame 5.

Structurally, these feed means 14 are evenly distributed around the channel 6 formed by the frame 5 and they form the final stretch of the frame 5.

Figure 9:
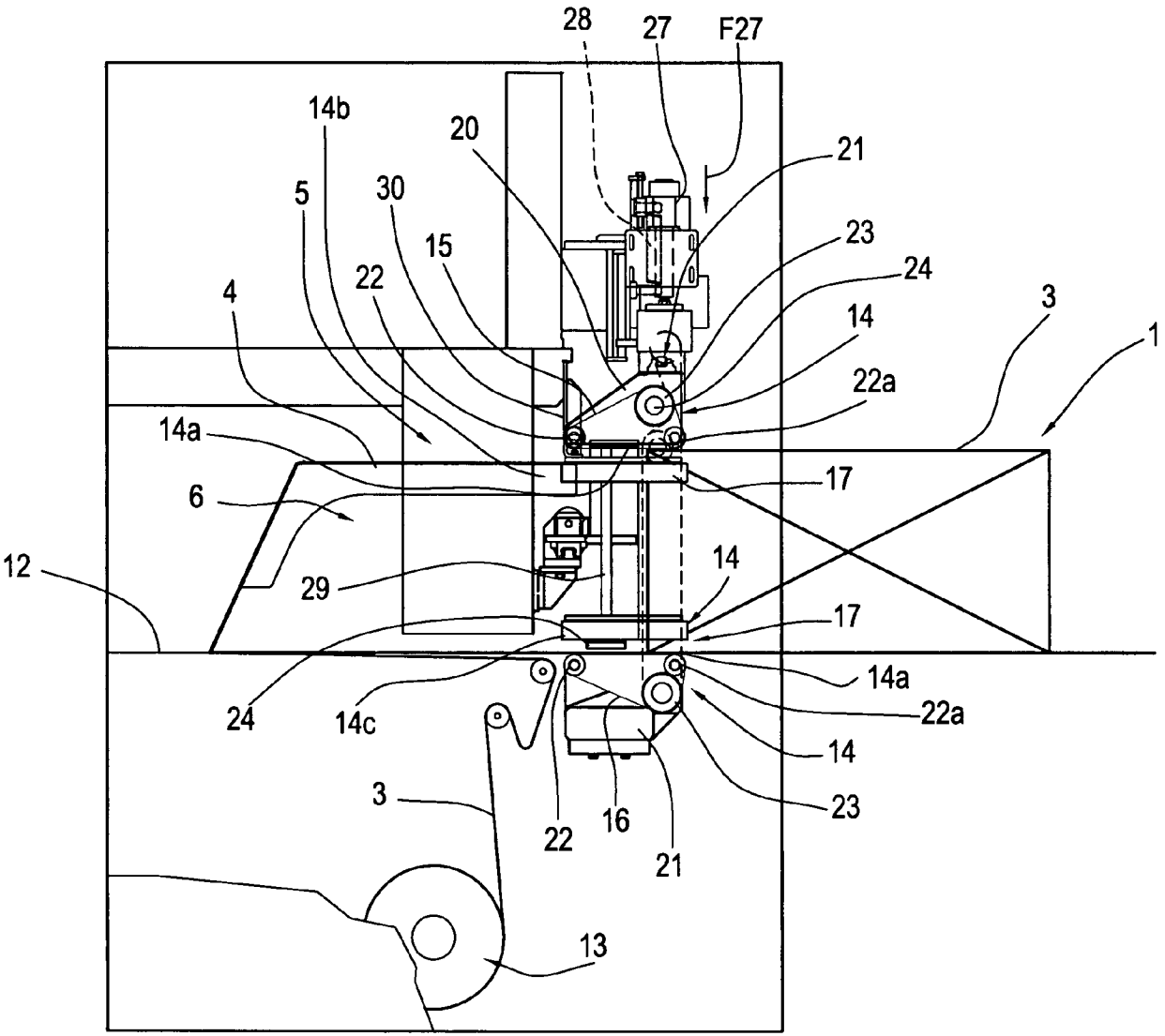
FIG. 9 is a side view with some parts cut away to better illustrate others, of the bagging machine of FIG. 2.
Figure 10:
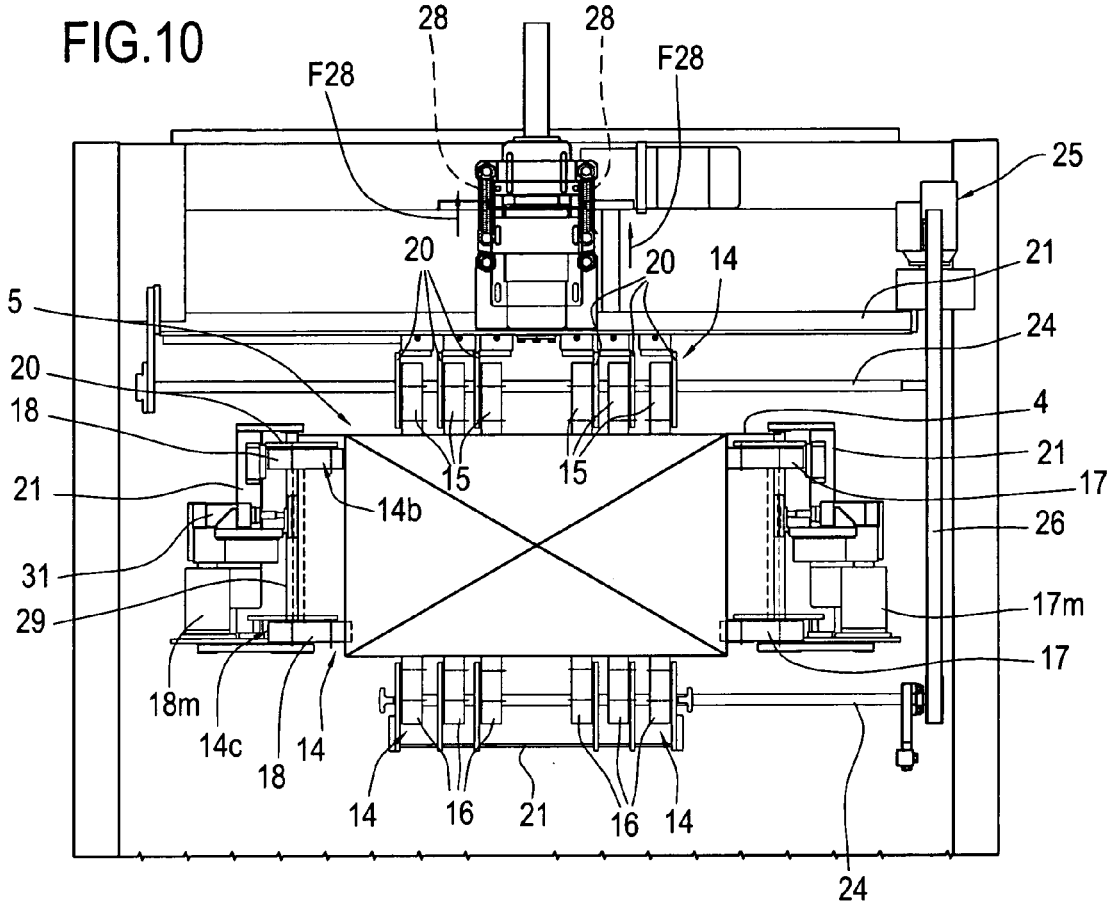
FIG. 10 is a front view with some parts cut away to better illustrate others, of the bagging machine of FIG. 2.
Figure 11:
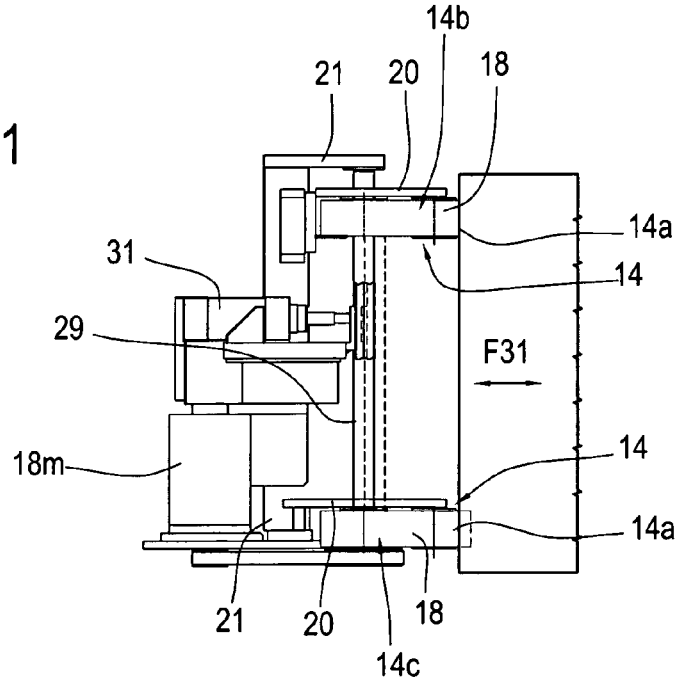
FIG. 11 is an enlarged front view of a first detail of the bagging machine of FIG. 10.

More precisely, as shown in FIGS. 9 to 11, the feed means comprise a plurality of film 3 feed belts 14, positioned around the frame 5, forming the final stretch of the frame 5 so that they at least partly complete the channel 6 along all of its sides.

The group of belts 14 comprises: a first set 15 of upper belts and a second set 16 of lower belts opposite one another and present in equal numbers; a third and fourth set 17, 18 of lateral belts 14 opposite one another and present in equal numbers.

Each belt 14 of the first and second sets 15, 16 can preferably be positioned coplanar with the extension of the frame 5.

Similarly, each belt 14 of the third and fourth sets 17 and 18 can be positioned coplanar with the extension of the frame 5.

However, each belt 14 of the third and fourth sets 17 and 18 can preferably be positioned at an angle to the extension of the frame 5, that is to say, projecting into the channel 6, and its position can be adjusted according to the contact with the film 3 and the product groups 2 fed forward (as described below and illustrated in FIG. 12).

In terms of the construction architecture, each belt 14 of the four sets present is closed in a loop on a respective shaped support 20 designed to allow the formation of an active branch 14*a* for making contact with and feeding the film 3 simultaneously with the feeding of the product groups 2.

Each support 20 is associated with a supporting base 21 shared by each of the first, second, third and fourth sets 15, 16, 17, 18 of belts 14 in order to maintain a stable fixed point for each set of belts 14 present.

Each of the shaped supports 20 has a first pair of wheels 22 and 22*a* which rotate idly (forming the active branch 14*a*) on which the belt 14 runs around the shaped support 20, and a second wheel 23 keyed on a transmission and supporting shaft 24, transversal to each shaped support 20, and shared by each of the sets 15, 16, 17, 18 of belts 14.

For movement of the belts 14 of each set, each of the belts 14 may rotate idly about the shaped support 20 and may be moved by means of pressure on the film 3 when the product groups 2 pass.

Preferably, although without limiting the scope of the invention, at least the first and second sets 15 and 16, upper and lower, may be motor-driven, by a single drive unit 25 connected to a kinematic motion transmission system 26 positioned at the ends of the respective transmission and supporting shafts 24.

Similarly, the third and fourth sets 17 and 18 of belts 14 may be motor-driven by corresponding independent drive units 17*m* and 18*m*.

Returning to the first set 15 of upper belts 14, the latter, partly overhanging the channel 6, are subject to an actuator 27, positioned above the channel 6, and acting vertically on the shaped supports 20 so as to maintain a predetermined pressure on the feed belts 14 and to allow them to constantly adhere to the film 3 and the product groups 2 passing (see arrow F27 in FIG. 9).

In addition, there are damper means 28 (for example springs), acting between the actuator 27 and the shaped supports 20, to allow both constant adjustment of the contact between the belts 14 and the film 3 in contact with the product groups 2, and movement of the belts 14 away from the film 3 upon the release of the pressure applied by the actuator 27 simultaneously with sealing of the rear edges 11 of the pack 1 (see arrow F28 in FIG. 10).

Figure 12:
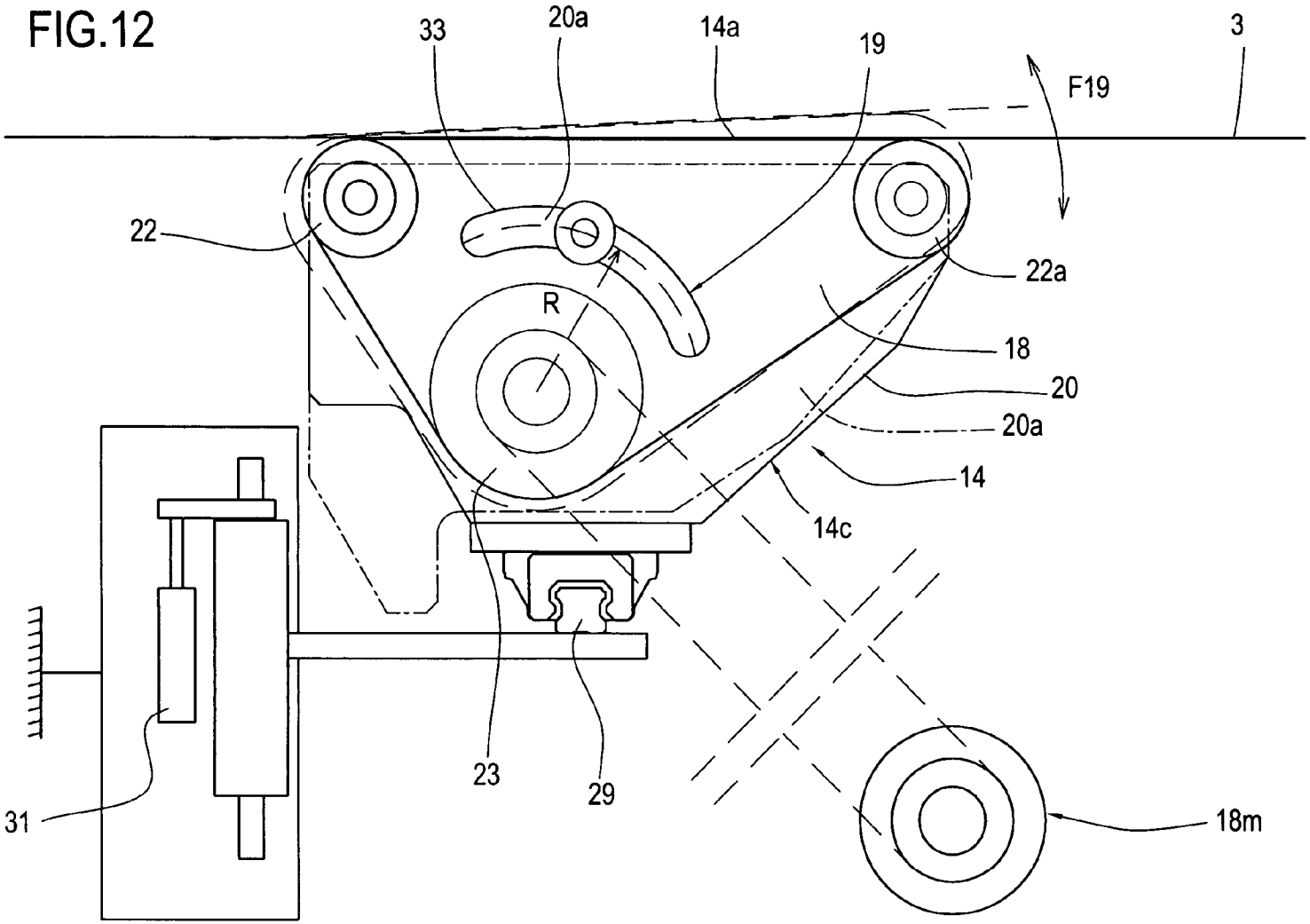
FIG. 12 is a schematic top plan view with some parts cut away to better illustrate others, of a detail of lateral feed belts.

As regards the third and fourth sets 17 and 18 of lateral belts 14, each of these sets 17 and 18 may preferably but without limiting the scope of the invention, comprise a pair of belts 14*b* and 14*c*, slidably connected, with the support 20, to a vertical guide 29 (see also FIG. 12).

By means of a rod 30, each upper belt 14*b* is integral with the first set 15 of upper belts 14 so as to maintain a constant distance from the first set 15 of belts 14 according to a vertical movement of the first set 15 of belts 14. The adjustment is necessary in known changeover procedures in which the entire channel 6 must be adapted for the new configuration.

Similarly, the third and fourth sets 17 and 18 of belts 14 are controlled by a cylinder 31, acting perpendicularly on the corresponding vertical guide 29 to obtain a variation of the position of the sets 17 and 18 of belts 14, moving them towards or away from one another (see arrow F31 in FIG. 11), depending on the configurations of the product groups 2 being handled, and moving the film 3 away when the rear edges 11 of a pack 1 are sealed, as already indicated regarding the first set 15 of belts.

As indicated above, the angle of each of the third and fourth sets 17 and 18 of lateral belts 14 can be adjusted using positioning means 19.

These means 19 (see FIG. 12) may comprise a curved slot 33 made in a mobile portion 20*a* of the shaped support 20 and concentric to the center of the second wheel 23 keyed on the motion transmission shaft 24: in this way it is possible to achieve predetermined angular positioning of the belts 14 irrespective of the position of the guide 29 and of the fixed part of the support 20 (see arrow F19 in FIG. 12).

A method and machine structured in this way therefore achieve the preset aims, thanks to the presence of the feed belts which form the final stretch of the wrapping channel.

The belts allow the film to be fed simultaneously with the product groups, keeping the latter away from the sealed front end during the step for forming the rest of the wrapper until it is complete.

This procedure has two obvious advantages:

the first is that it eliminates the impact on the front end of the film just sealed and prevents it from being held taut for the entire time the product groups are fed forward, since in the conventional method the sealed front end is used to allow the film to exit the frame;

the second advantage, resulting from the first, is that the packaging process is speeded up, since it is not necessary to wait for the post-sealing cooling time to elapse for the front of the film, which now takes place in a "masked" time, that is to say during the step in which the film and product groups are fed forward.

In this way the production cycle is faster than the conventional cycle and the end quality of the product (in terms of the seals) is definitely higher.

The invention described is suitable for obvious industrial applications and can be modified and adapted in several ways without thereby departing from the scope of the inventive concept. Moreover, all details of the invention may be substituted by technically equivalent elements.

What is claimed is:

1. A method for producing a pack (1) for groups (2) of roll products; the method comprising at least the following steps:

forming of a continuous tube of film (3) around supporting and folder means (4) which constitute a frame (5) forming a channel (6) for the passage of the product groups (2);

creation of a first seal (S1) on the front edges (7) of the packaging film (3), using first, transversal sealing means (8) positioned close to the front end of the frame (5);

insertion in the channel (6), by pusher means (9), of a predetermined number of product groups (2), fed until they are close to the closed front end (7) of the film (3);

further feeding of the product groups (2) beyond the first sealing means (8), with simultaneous feeding of the film (3) and formation of the further portion of the pack (1) beyond the frame (5);

creation of a second, longitudinal seal (S2) on the overlapping longitudinal edges of the film (3), by second sealing means (10), simultaneously with the further feed step;

creation of a third seal (S3) on the rear edges (11) of the film (3), by the first, transversal sealing means (8), designed to close the pack (1) at the rear of the product groups (2) bagged; wherein, between the step of inserting product groups (2) in the channel (6) and the further feeding of said product groups (2), there is a step of feeding the film (3) wound around the frame (5), by respective means (14); this feed step being simultaneous with and in the same direction as the feeding of the product groups (2) and designed to allow a fixed distance (D) to be maintained between the closed front end (7) of the film (3) and the front end (2*a*) of the product groups (2) fed forward.

2. The method according to claim 1, wherein the film (3) feed step continues at least until the product groups (2) completely exit the channel (6).

3. The method according to claim 1, wherein the film (3) feed step continues at least until the first, front seal (S1) cools.

4. The method according to claim 1, wherein the film (3) feed step continues at least until the product groups (2) are positioned beyond the first, transversal sealing means (8).

5. The method according to claim 1, wherein, before said step for creation of a third seal (S3) on the rear edges (11) of the film (3), there is a further step, performed by pusher means (9), of feeding the product groups (2) until the product groups (2) make contact with the front end (7) of the film (3).

6. The method according to claim 1, wherein the film (3) feed step begins at and simultaneously with the arrival of the product groups (2) close to the front end of the frame (5).

7. The method according to claim 1, wherein the feed step is performed evenly along the entire perimeter of the film (3) formed by the channel (6).

* * * * *